United States Patent [19]

Cirasuolo et al.

[11] 4,169,638

[45] Oct. 2, 1979

[54] DRAINBOARD—EXTEND-A-DRAIN

[75] Inventors: Edward J. Cirasuolo, West Haven, Conn.; Rocco Cirasuolo, St. Petersburg, Fla.

[73] Assignee: New Ideas, Inc., Hamden, Conn.

[21] Appl. No.: 904,878

[22] Filed: May 11, 1978

[51] Int. Cl.[2] ..... A47B 77/06

[52] U.S. Cl. ..... 312/229; 312/228; 211/41

[58] Field of Search ..... 312/229, 228, 322, 205, 312/297, 298, 299, 301; 211/41

[56] References Cited

U.S. PATENT DOCUMENTS

| | | | |
|---|---|---|---|
| 1,001,520 | 8/1911 | Greason | 312/229 |
| 1,224,838 | 5/1917 | Blissman et al. | 211/41 |
| 1,369,902 | 3/1921 | Miller et al. | 312/228 |
| 1,889,146 | 11/1932 | Kalenoff | 211/41 |
| 2,197,178 | 4/1940 | Gates | 211/41 |
| 2,473,862 | 6/1949 | Clawsey | 312/228 |
| 3,442,395 | 5/1969 | Taylor | 211/41 |
| 3,756,681 | 9/1973 | Croston | 312/229 |
| 3,800,957 | 4/1974 | Krause | 211/41 |

*Primary Examiner*—Victor N. Sakran

[57] ABSTRACT

An elongated hollow rear member has front and rear ends with an open front end and a top surface which extends inclinedly downward from its rear end to its front end. An elongated hollow middle member has front and rear ends with an open front end and a top surface which extends inclinedly downward from its rear end to its front end, the maximum height of the top surface of the middle member being less than the minimum height of the top surface of the rear member. A first device cooperates with the rear and middle members to establish a slideable interconnection therebetween. The first device has an extended position at which the rear end of the middle member is disposed adjacent but in front of the front end of the rear member and has a withdrawn position at which the rear end and of at least a substantial adjacent portion of the middle member is disposed within the front end and a substantial adjacent portion of the rear member. An elongated front member has front and rear ends and a top surface which extends inclinedly downward from its rear end to its front end, the maximum height of the top surface of the front member being less than the minimum height of the top surface of the middle member. A second device cooperates with the middle and front members to establish a slideable interconnection therebetween. The second device has an extended position at which the rear end of the front member is disposed adjacent but in front of the front end of the middle member and a withdrawn position at which the rear end and at least a substantial portion of the front member is disposed within the front end and a substantial adjacent portion of the middle member. A glass rack is secured to the rear member, a dish rack is secured to the middle member, and a silverware holder is secured to the front member.

15 Claims, 20 Drawing Figures

FIG. 2
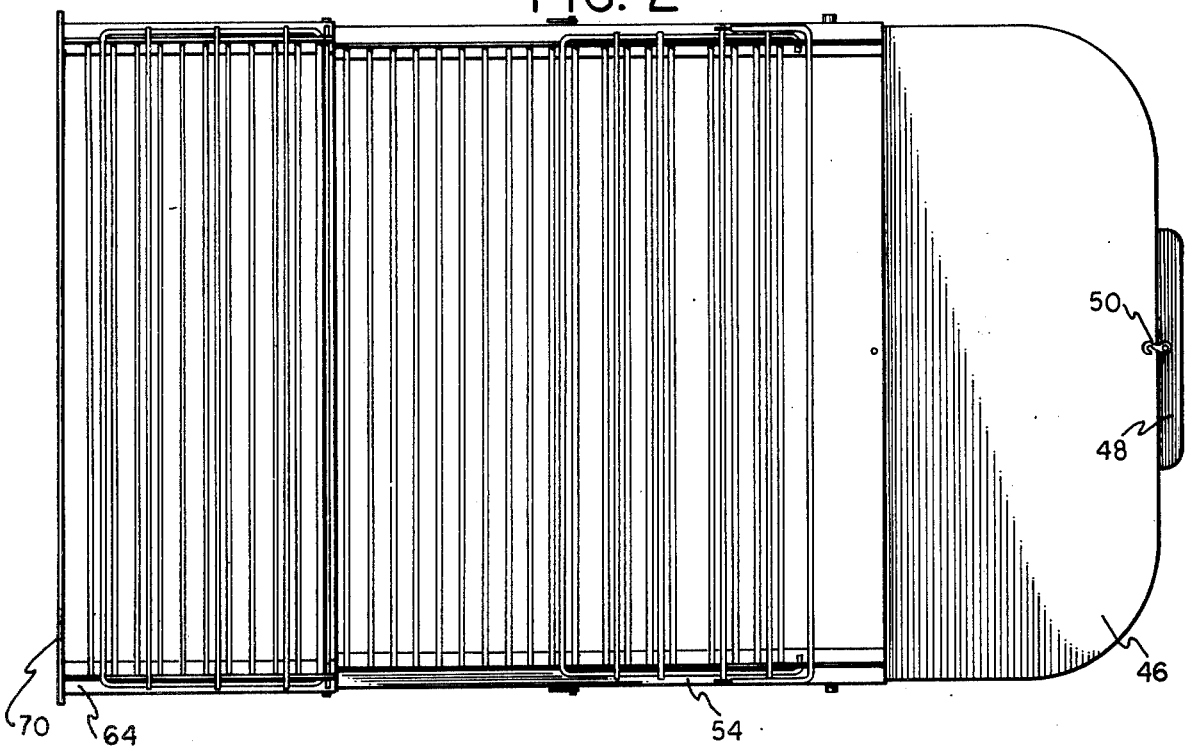
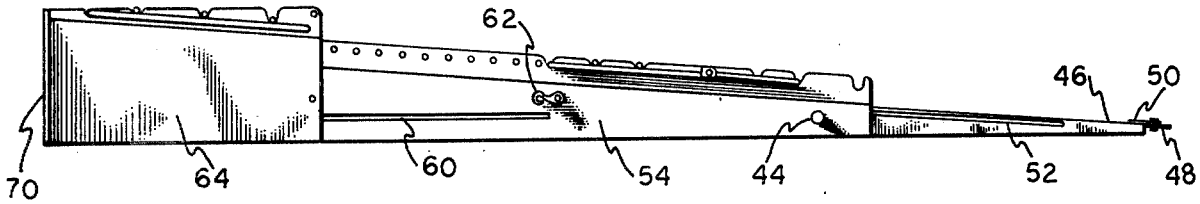
FIG. 3
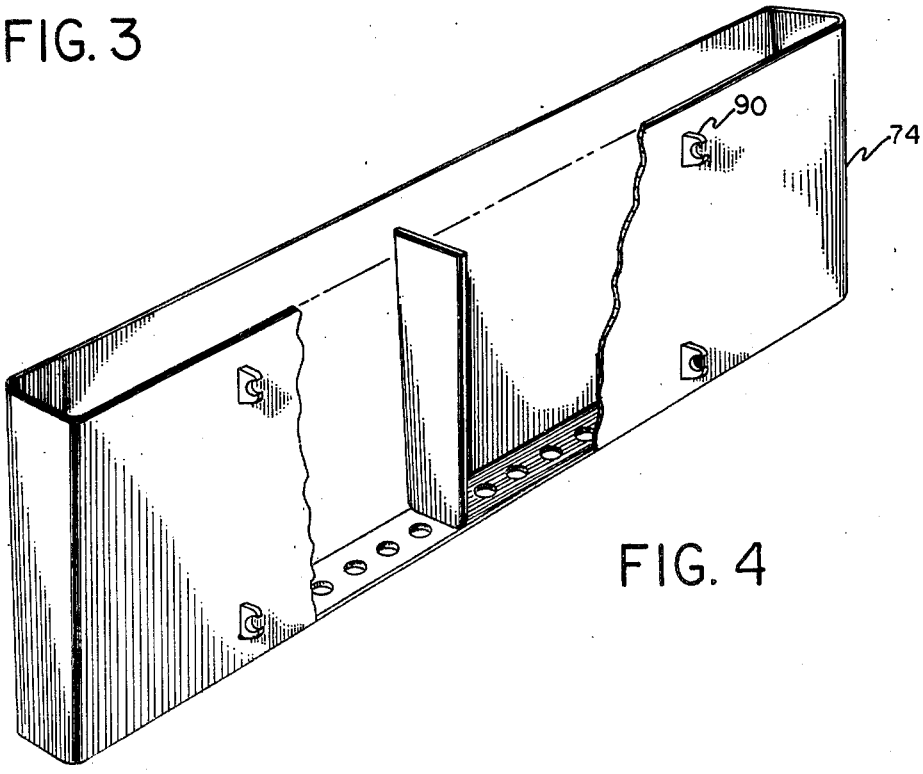
FIG. 4

FIG. 13
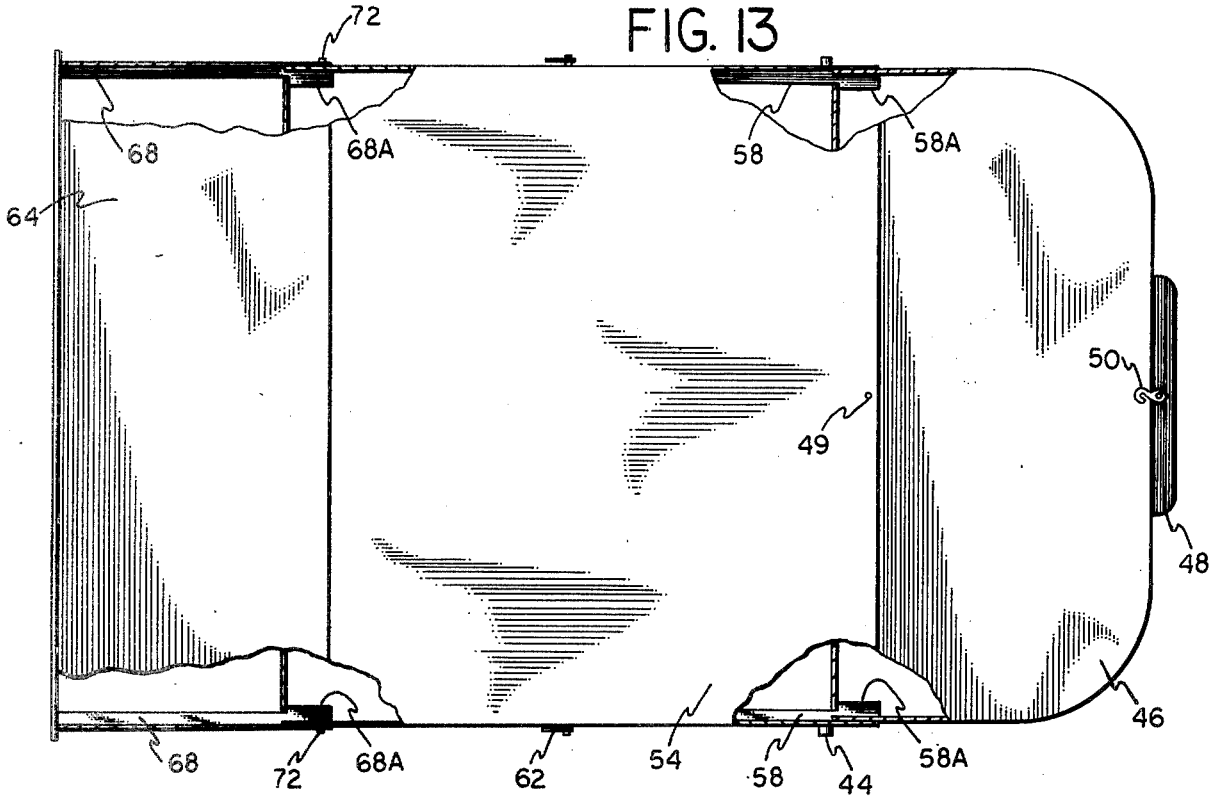
FIG. 14
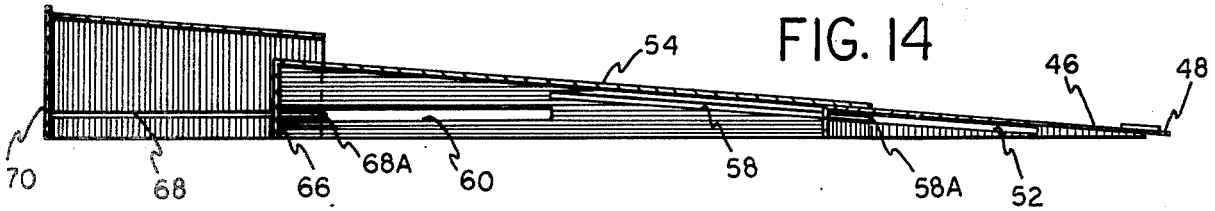
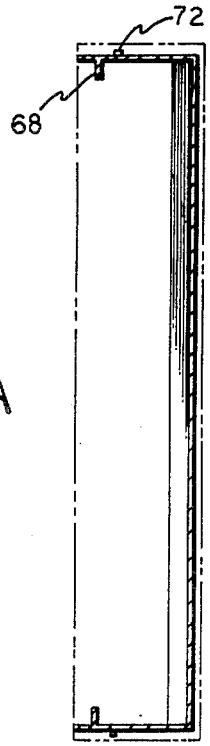
FIG. 15A
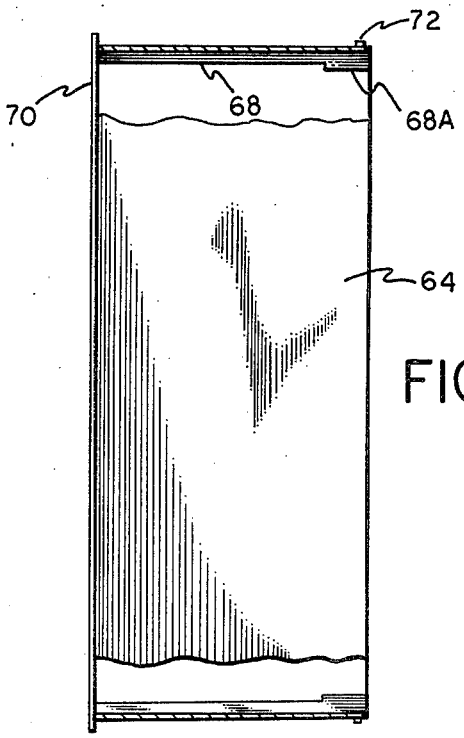
FIG. 15B

DRAINBOARD—EXTEND-A-DRAIN

PRIOR ART STATEMENT

U.S. Pat. No. 2,222,960 shows a one-piece rigid drainboard which can be retracted and stored in a vertical recess when not in use. Similar other retractable boards or covers which can be stored in vertical recesses when not in use are shown in U.S. Pat. Nos. 354,917, 3,734,590, 2,049,080, and 1,903,091. The invention herein differs both in structure and function from those shown in these patents.

SUMMARY OF THE INVENTION

In accordance with the principles of this invention, the drainboard employs an elongated hollow rear member having front and rear ends, its front end being open, the rear member having a top surface which extends inclinedly downward from its rear end to its front end.

An elongated hollow middle member having front and rear ends, its front end being open, is also used. This middle member has a top surface which extends inclinedly downward from its rear end to its front end, the maximum height of the top surface of the middle member being less than the minimum height of the top surface of the rear member.

First means cooperates with the rear and middle members to establish a slidable interconnection therebetween, said first means having an extended position at which the rear end of the middle member is disposed adjacent but in front of the front end of the rear member. Said first means having a withdrawn position at which the rear end and at least a substantial adjacent portion of the middle member is disposed within the front end and a substantial adjacent portion of the rear member.

An elongated hollow front member having front and rear ends is further employed. This front member has a top surface which extends inclinedly downward from its rear end to its front end, the maximum height of the top surface of the front member being less than the minimum height of the top surface of the middle member.

Second means cooperates with middle and front members to establish a slidable interconnection therebetween, said second means having an extended position at which the rear end of the front member is disposed adjacent but in front of the front end of the middle member, said second means having a withdrawn position at which the rear end and at least a substantial portion of the front member is dispoed within the front end and a substantial adjacent portion of the middle member.

In use, the three members are disposed in extended position on a suitable support such as the top of a counter with the first member extending into a sink or other drain. Racks or other devices secured to the top surfaces of the members hold wet dishes, glasses, and silverware which are to be dried, the water draining along the inclined top surfaces of the members into the sink.

After various items to be dried have been removed and the racks or other devices removed or folded flat, the members are placed into the withdrawn position. The front end of the middle member slidably engages a vertical track in a vertical frame extending downwardly below the top of the counter, there being a small top opening in the counter to expose the frame. The members can be locked into the withdrawn position if desired and then swung into the frame whereby the entire drainboard can be stored within the frame leaving only the top opening exposed. The rear end of the rear member can be used if desired as a cover to conceal the opening.

Thus the invention permits use of a drainboard in a confined small kitchen space in which storage facilities are minimal without requiring a portion of these facilities to be used for storage of an unused drainboard. Th segmented drainboard and frame can be manufactured and installed inexpensively and easily both in existing kitchens and new kitchens.

BRIEF DESCRIPTION OF THE DRAWINGS

FIG. 2 is a top view thereof.

FIG. 3 is a side view thereof.

FIG. 4 is a perspective view of a silverware holder usable with the drainboard.

FIG. 13 is a top view of the drainboard in extended position with the dish and glass racks removed as partially cut away to expose the engaging tracks and the connecting pin.

FIG. 14 is a side view of the structure shown in FIG. 13.

FIG. 15*a* is a detail end view of the rear member with glass rack removed.

FIG. 15*b* is a detail plan view of the member in FIG. 15*a*.

DETAILED DESCRIPTION OF PREFERRED EMBODIMENTS

Figure 1:
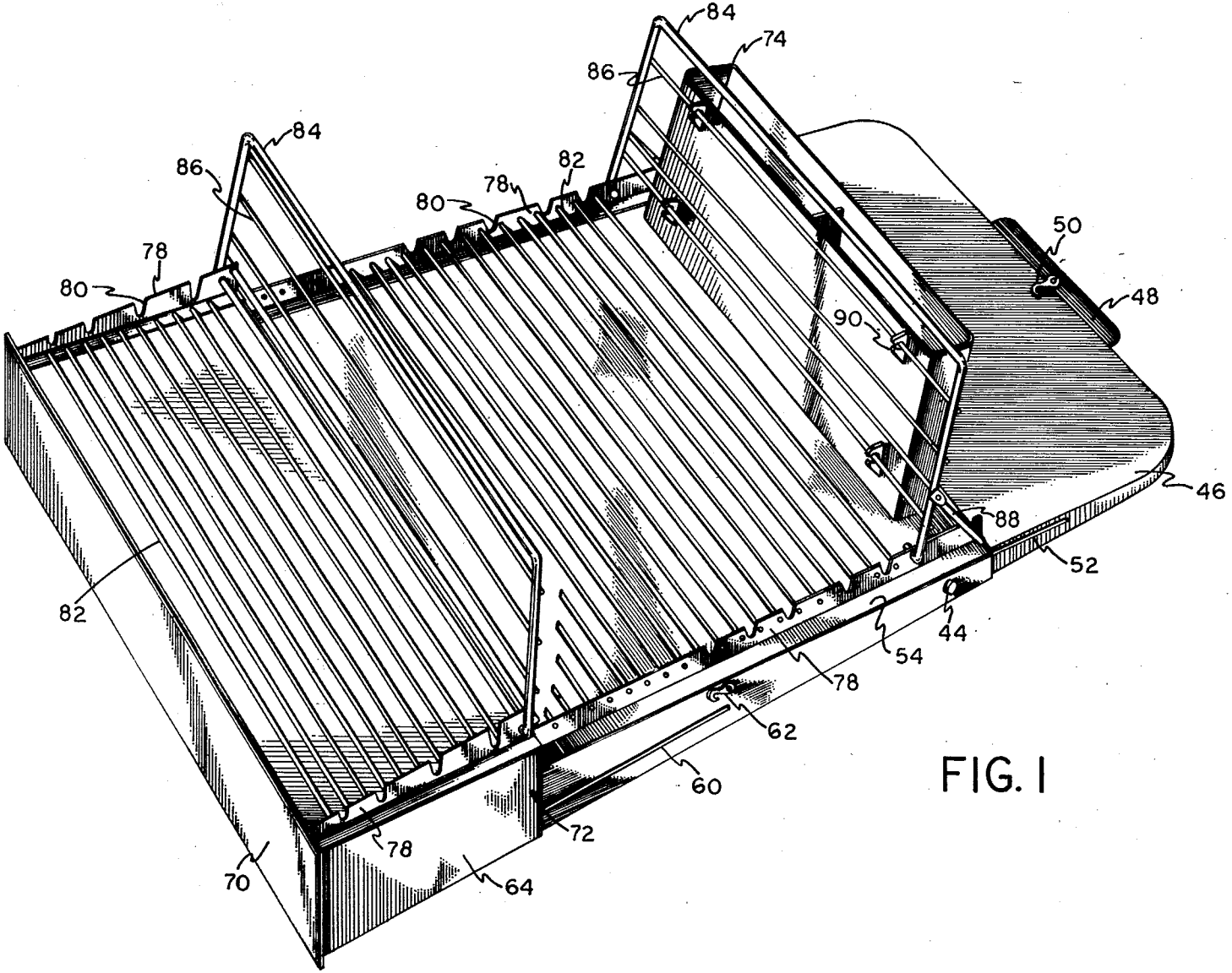
FIG. 1 is a perspective view of the drainboard in extended position but detached from the vertical frame in which it can be stored.
Figure 5:
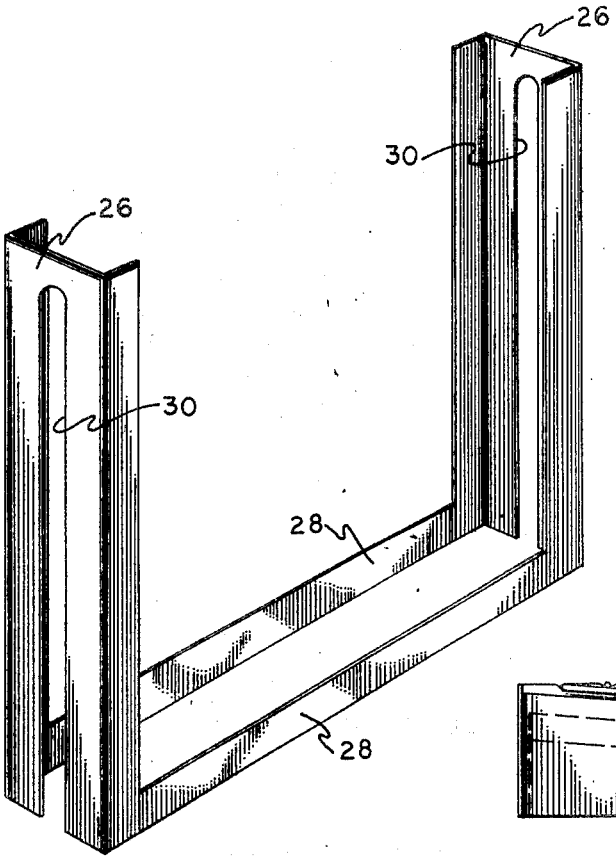
FIG. 5 is a perspective view of a counter frame usable with the drainboard.
Figure 6:
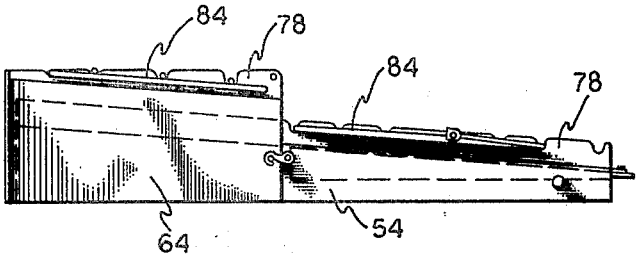
FIG. 6 is a side view of the drainboard in withdrawn position.
Figure 7:
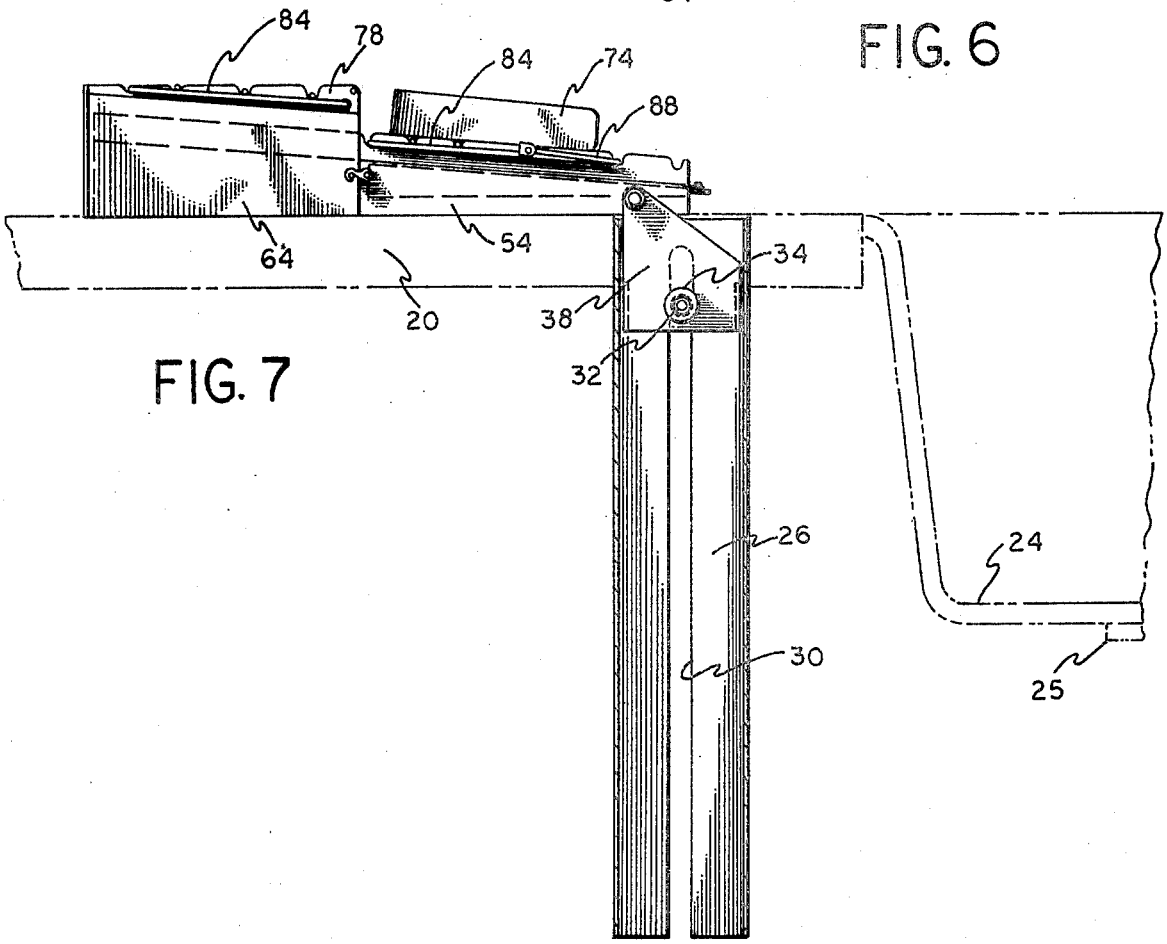
FIG. 7 is a side view of the drainboard in horizontal withdrawn position as connected to the counter frame.
Figure 8:
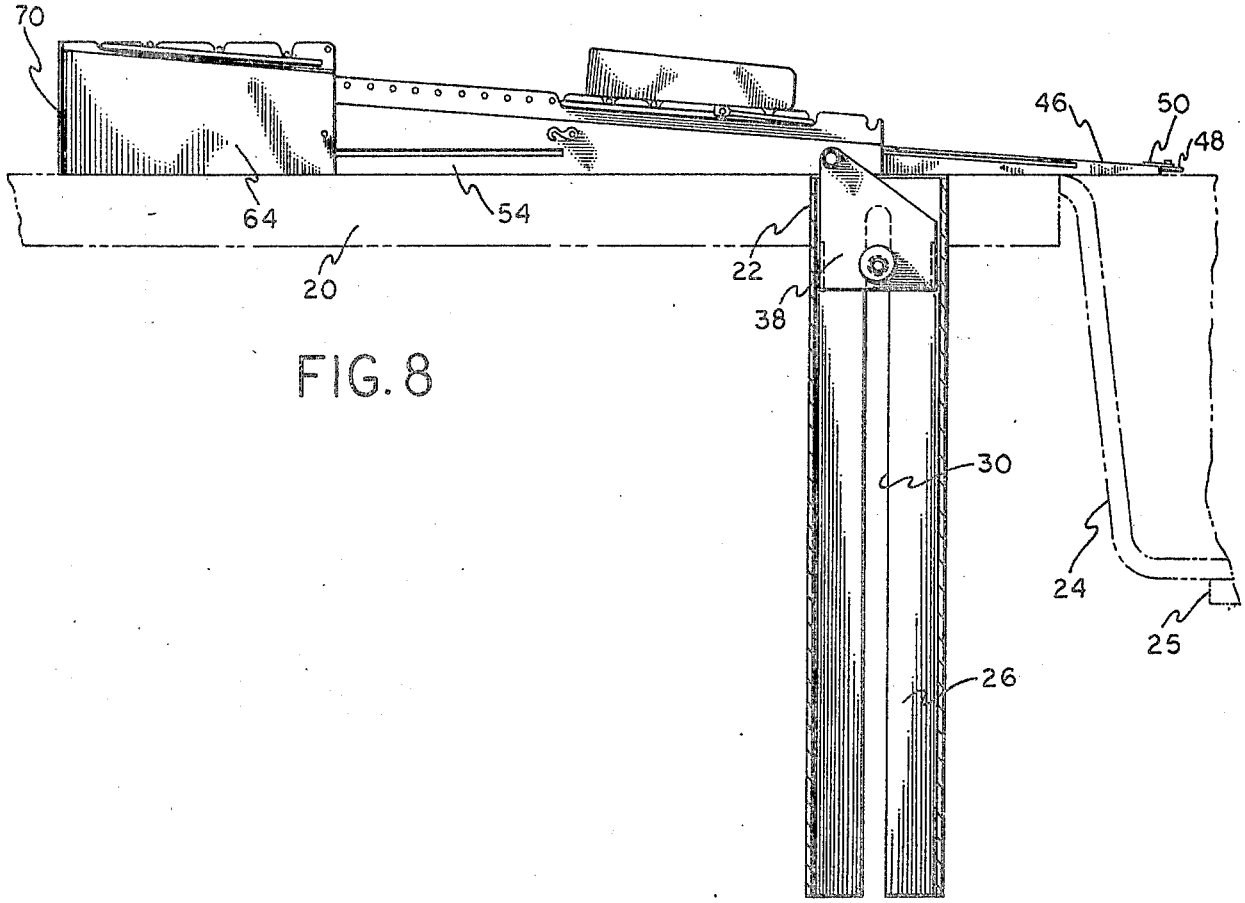
FIG. 8 is a view similar to FIG. 7 but showing the drainboard in extended position.
Figure 9:
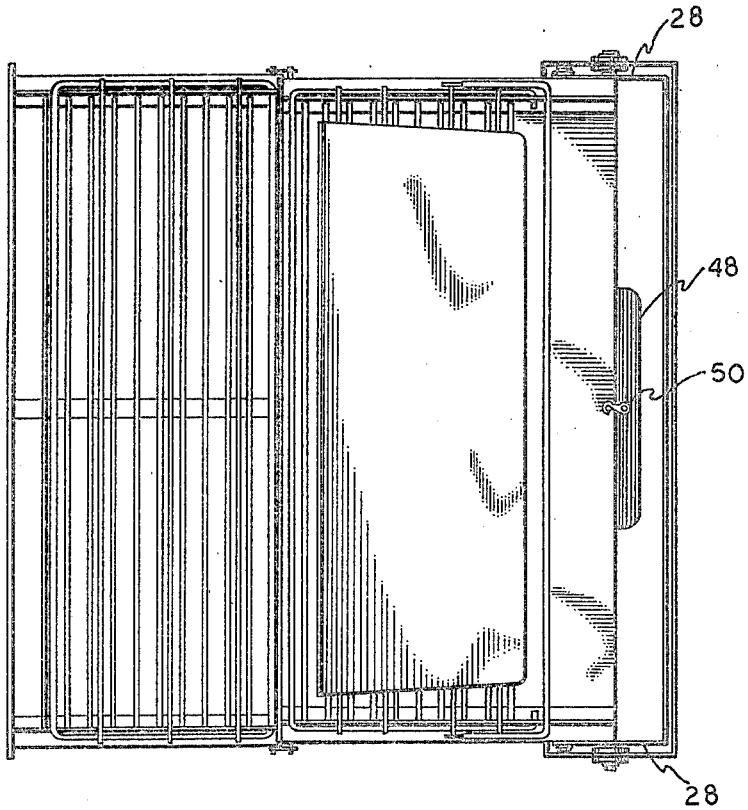
FIG. 9 is a top view of the structure of FIG. 7.
Figure 10:
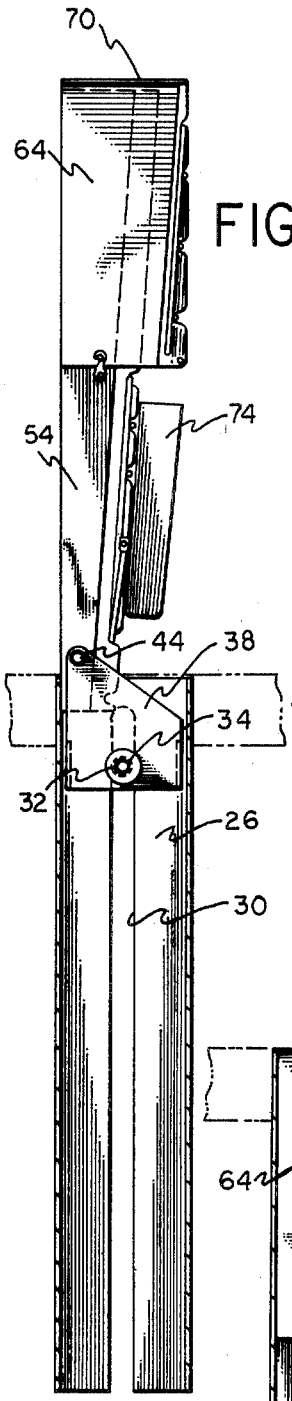
FIG. 10 is a view similar to FIG. 7 but showing the drainboard in vertical position above the counter frame.
Figure 11:
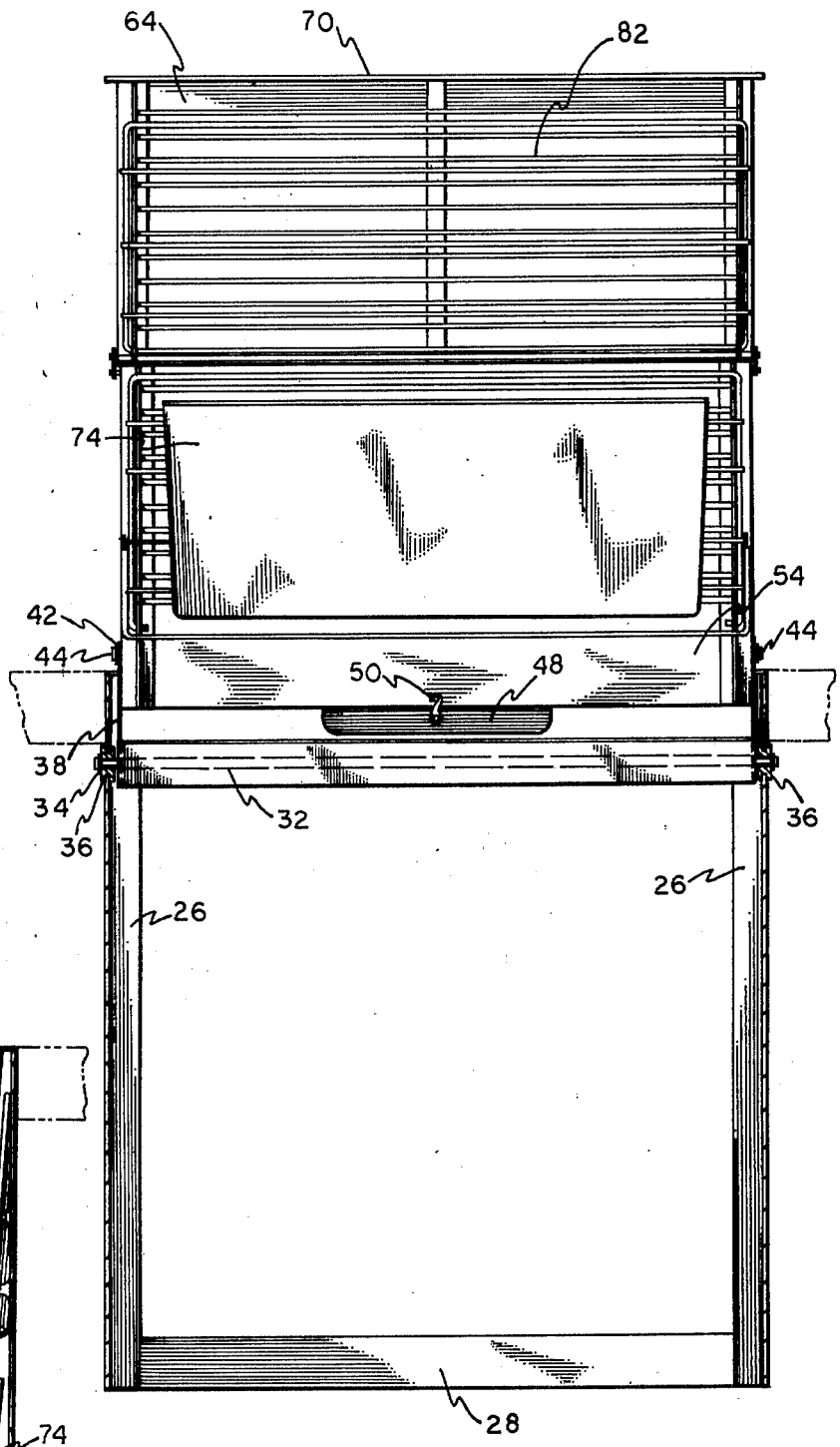
FIG. 11 is a vertical front view of the structure of FIG. 10.
Figure 12:
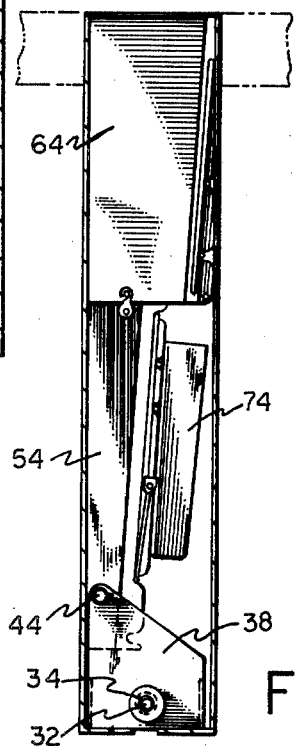
FIG. 12 is a view similar to FIG. 10 but showing the drainboard stored within the counter frame.
Figure 16A:
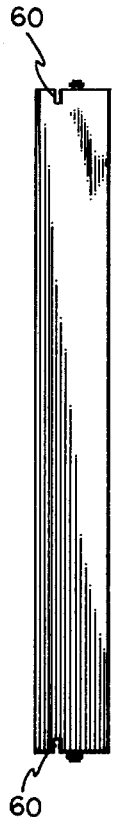
FIG. 16*a* is a detail end view of the middle member with dish rack removed.
Figure 16B:
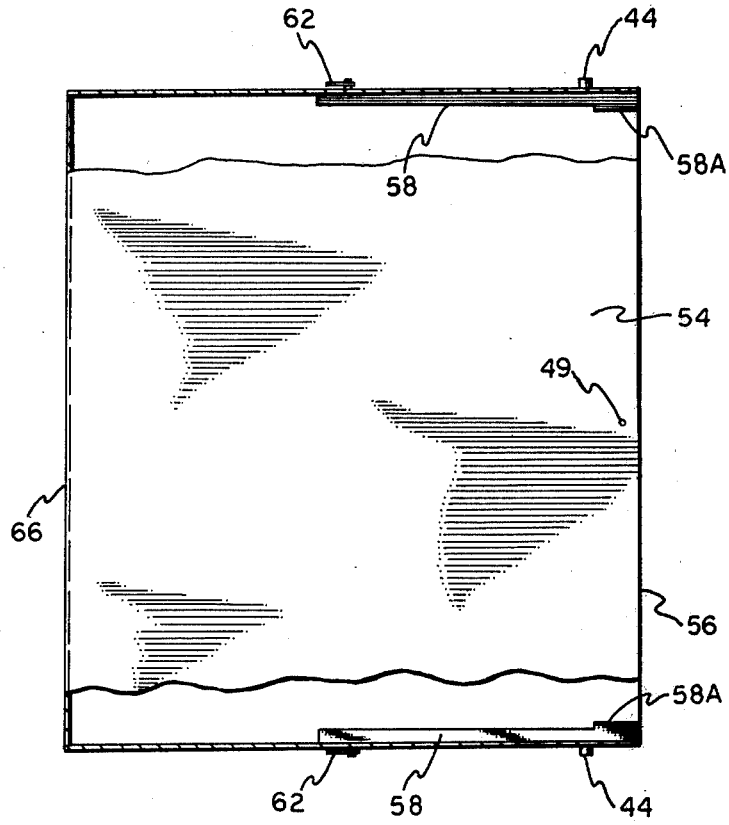
FIG. 16*b* is a detail plan view of the member in FIG. 16*a*.
Figure 17A:
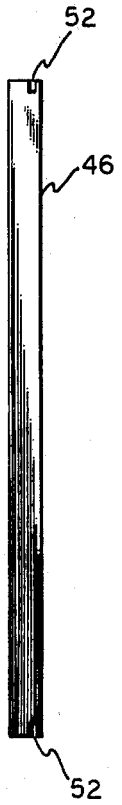
FIG. 17*a* is a detail end view of the front member.
Figure 17B:
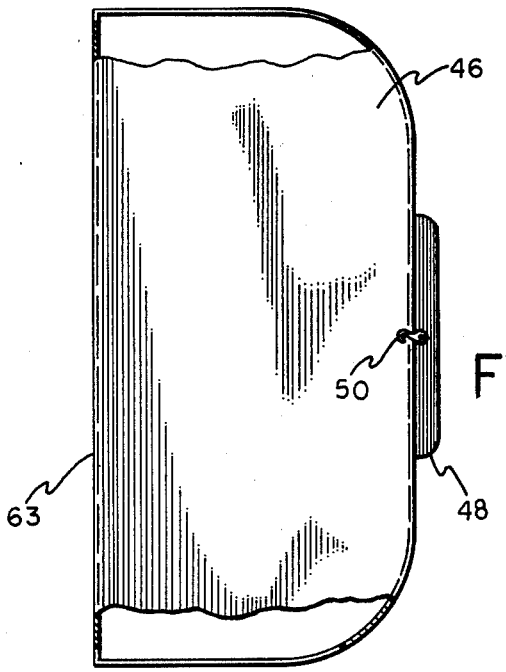
FIG. 17*b* is a detail plan view of the member in FIG. 17*a*.

Referring now to FIGS. 1–17, a counter top 20 has a small rectangular opening 22 disposed adjacent a sink 24 having a drain 25. A counter frame is disposed below the opening with the top ends of two oppositely disposed vertical legs 26 being flush with the counter top in the opening 22 and extending downward, these legs being joined at their bottom ends by a horizontally elongated support 28 extending therebetween. Each leg carries a vertically elongated slot or track 30 which extends from the bottom end to a point adjacent but below the top end. A horizontal roller shaft 32 extends between the legs, each end of the shaft being secured by a snap ring 34 to a roller 36 riding in the corresponding track. The roller shaft 32 extends within a connecting frame 38 which moves up and down and pivotally with the shaft.

A forward or front elongated member 46 is open at bottom and is hollow. Its front end is closed and carries a transverse horizontal finger grip 48 having a top disposed horizontal latch 50. The vertical opposite sides of member 46 have horizontally elongated slots 52. The top surface of the member 46 slopes downward from its rear end to its front end. The midpoint of the top surface of member 46 carries a vertical upstanding pin 49 adjacent the front end of member 46.

A hollow elongated middle member 54 has an open front end 56 which is somewhat wider and deeper than the rear end 62 of member 46. The bottom of member 54 is open as is its rear end. This rear end is deeper than its front end since the top surface of member 54 also slopes downward from rear to front. The inner surfaces of opposite sides of member 54 have horizontal elongated tracks 58 which slidably engage slots 52 of member 46 and which are disposed in somewhat more than the front half portion of member 46. The rear half portion of member 54 along the sides and below the tracks horizontally elongated connecting slots 60. The outer surfaces of these sides carry mid-disposed vertical latches 62.

Tracks 58 have front portions **58*a* which are wider than the remainder of the tracks and are also wider than the depth of slots 52 in the rear end 66 of member 46. These portions 58*a* are always disposed within member 46 whereby member 46 can be slid into and out of member 54** without being detached therefrom.

The connecting frame 38 as viewed on end has a rectangular bottom portion with an integral top extension defining a right triangle with a projecting vertex. A small roller 40 is disposed in each vertex, held therein by a snap ring 42 and supporting a pin 44. These pins 44 are secured to the outer surface of the sides of member 54 adjacent its front end whereby member 54 is pivotally secured to the connecting frame 38.

A hollow elongated rear member 64 has a front open end which is somewhat wider and deeper than the rear end 66 of member 54. Member 64 is provided with horizontal elongated tracks 68 disposed along the inner surface of its sides and which slidably engage slots 60. Tracks 68 have front portions **68*a* which are wider than the remainder of the tracks and are also wider than the depth of slots 60 in the rear end 66 of member 54. These portions 68*a* are always disposed within member 54 whereby member 54 can be slid into and out of member 54 without being detached therefrom. The rear end 70 of member 64 is enlarged to act as a cover over opening 22 when the drainboard is stored in withdrawn position. The outer surfaces of the sides of member 64 carry transverse outwardly extending horizontal pins 72** adjacent the front end.

Thus by sliding the members into and out of each other, the extended or withdrawn positions can be obtained. When the withdrawn position is in use, member 46 is totally disposed within member 54 except for finger grip 48 and these two members can be locked in this positon by engaging pin 49 by latch 50. Similarly, almost the entire rear half of member 54 is disposed within member 64 and these two members can be locked in this position by engaging pins 72 with latches 62.

When the members are in the withdrawn position, the drainboard can be placed in or removed from the opening 22 as shown.

An elongated hollow container 74 has bottom perforations and is adapted to hold silverware and the like for draining and drying. This container must be removed before the member 46 is slid within member 54.

A folding rack for glasses is secured to the top surface of the rear member 64. This rack includes two opposite parallel vertical shallow elongated plates 78 having vertically inclined notches 80. Spaced horizontal bars 82 extend between the plates below the notches and above the top surface of the member. A U-shaped member 84 carrying parallel horizontal bars 86 is pivotable between a closed position at which it lies flat in the notches and an open position at which it is disposed vertically.

A similar structure for supporting dishes, that is a folding dish rack is secured to the middle member. This rack has similar parallel notched plates 78 with horizontal interconnecting bars 82 disposed below the notches 80 and above the inclined top surface. This rack has a similar U-shaped member 84 with a pivotally secured locking bar 88.

The container 74 is detachably securable to the member 84 and/or its bars 86 by clips 90. Water drains out of the bottom of the container onto the inclined surface of the front member.

Thus the water draining from the racks and container flows along the inclined top surfaces into the sink or other drain.

We claim:

1. A drainboard comprising:

an elongated hollow rear member having front and rear ends, its front end being open, the rear member having a top surface which extends inclinedly downward from its rear end to its front end;

an elongated hollow middle member having front and rear ends, its front end being open, the middle member having a top surface which extends inclinedly downward from its rear end to its front end, the maximum height of the top surface of the middle member being less than the minimum height of the top surface of the rear member;

first means cooperating with the rear and middle members to establish a slidable interconnection therebetween, said first means having an extended position at which the rear end of the middle member is disposed adjacent but in front of the front end of the rear member, said first means having a withdrawn position at which the rear end and at least a substantial adjacent portion of the middle member is disposed within the front end and a substantial adjacent portion of the rear member;

an elongated front member having front and rear ends, the front member having a top surface which extends inclinedly downward from its rear end to its front end, the maximum height of the top surface of the front member being less than the minimum height of the top surface of the middle member; and second means cooperating with middle and front members to establish a slidable interconnection therebetween, said second means having an extended position at which the rear end of the front member is disposed adjacent but in front of the front end of the middle member, said second means having a withdrawn position at which the rear end and at least a substantial portion of the front member is disposed within the front end and a substantial adjacent portion of the middle member.

2. The drainboard of claim 1 wherein said middle member is longer than either of the other two members.

3. The drainboard of claim 2 further including a glass rack secured to the top surface of one of said members.

4. The drainboard of claim 3 further including a dish rack secured to the top surface of another one of said members.

5. The drainboard of claim 4 further including a silverware holder overlying the top surface of yet another one of said members.

6. The drainboard of claim 5 wherein the glass rack is secured to the rear member, the dish rack is secured to the middle member, and the silverware holder overlies the front member.

7. The drainboard of claim 5 wherein when the first means is in the withdrawn position, almost half of the middle member is disposed within the rear member and wherein when the second means is in the withdrawn position, almost all of the front member is disposed within the middle member.

8. The drainboard of claim 7 further including a vertical counter frame and third means pivotably and slidably connecting said middle member to said counter frame.

9. The drainboard of claim 8 wherein said counter frame has two parallel spaced vertical slots and the third means includes a horizontal shaft extending between said slots, each of the two ends of said shaft being slidably and rotatably disposed in a corresponding one of said slots.

10. The drainboard of claim 9 wherein each end of the shaft is secured to a corresponding roller disposed in the corresponding slot.

11. The drainboard of claim 10 wherein said third means includes a connecting frame in which said shaft extends, said connecting frame moving with said shaft.

12. The drainboard of claim 11 wherein the connecting frame as viewed on end has a rectangular bottom portion containing the shaft, the connecting frame having an integral top extension defining a right triangle with a projecting vertex, a roller being disposed in each vertex, each roller supporting a pin secured to said middle member.

13. The drainboard of claim 7 wherein each of said first and second means includes cooperating horizontally elongated tracks and slots.

14. The drainboard of claim 13 wherein the front member has slots, the rear member has tracks and the middle member has front disposed tracks and rear disposed slots.

15. The drainboard of claim 14 wherein the slots in the middle member and the tracks in the middle member are vertically spaced apart.

* * * * *